US007722368B2

(12) United States Patent
Jaouen et al.

(10) Patent No.: US 7,722,368 B2
(45) Date of Patent: May 25, 2010

(54) DEVICE FOR CONNECTING WITH SECURE ACCESS

(75) Inventors: Jean-Marc Jaouen, La Sône (FR); Didier Revol, Chatte (FR); Nathalie Foratier, Saint Antoine l'Abbaye (FR)

(73) Assignees: Legrand France (FR); Legrand SNC (FR)

( * ) Notice: Subject to any disclaimer, the term of this patent is extended or adjusted under 35 U.S.C. 154(b) by 0 days.

(21) Appl. No.: 12/369,378

(22) Filed: Feb. 11, 2009

(65) Prior Publication Data

US 2009/0203239 A1 Aug. 13, 2009

(30) Foreign Application Priority Data

Feb. 12, 2008 (FR) ..... 08 50861

(51) Int. Cl.
*H01R 13/44* (2006.01)

(52) U.S. Cl. ..... 439/133; 439/304; 439/352

(58) Field of Classification Search ..... 439/133, 439/135, 136, 304, 332, 352; 200/50.02, 200/50.04, 50.07, 50.09
See application file for complete search history.

(56) References Cited

U.S. PATENT DOCUMENTS

| | | | | |
|---|---|---|---|---|
| 4,080,029 | A * | 3/1978 | St. Fort | 439/131 |
| 4,479,688 | A * | 10/1984 | Jennings | 200/43.02 |
| 4,488,764 | A * | 12/1984 | Pfenning et al. | 439/133 |
| 4,603,931 | A * | 8/1986 | Ruffman | 439/133 |
| 4,640,564 | A | 2/1987 | Hill | 339/40 |
| 5,055,057 | A * | 10/1991 | Boyer | 439/134 |
| 5,061,199 | A * | 10/1991 | McClead | 439/304 |
| 5,190,466 | A * | 3/1993 | McVey | 439/304 |
| 5,193,665 | A * | 3/1993 | Jankow | 200/43.08 |
| 6,142,797 | A * | 11/2000 | Bailey | 439/134 |
| 6,428,333 | B1 * | 8/2002 | Rust | 439/140 |
| 7,080,889 | B2 * | 7/2006 | Ling et al. | 200/334 |
| 7,595,449 | B1 * | 9/2009 | Dyderski | 174/67 |
| 2006/0032733 | A1 | 2/2006 | Ling et al. | 200/334 |

FOREIGN PATENT DOCUMENTS

JP 2006-210107 8/2006

OTHER PUBLICATIONS

Rapport De Recherche Préliminaire of French Application No. 0850861 mailed Sep. 30, 2008.

* cited by examiner

*Primary Examiner*—Neil Abrams
*Assistant Examiner*—Phuong Nguyen
(74) *Attorney, Agent, or Firm*—Seyfarth Shaw LLP; Richard P. Gilly

(57) ABSTRACT

The invention relates to a device for connecting with secure access, comprising a socket (1), a movable plug (non visible), a protective case (3) equipped with a mobile flap (4), and locking members. According to the invention, the locking members include a mobile latch (5), a runner (6), and a key (7) in order to maneuver the latch in the runner, the latch (5) being designed to retain the flap (4) in the closed configuration of the case (3), and in order to retain the plug in the state of use of this device.

12 Claims, 4 Drawing Sheets

DEVICE FOR CONNECTING WITH SECURE ACCESS

FIELD

The invention relates to, generally, the fields of connections and of security.

More precisely, the invention relates to a device for connecting with secure access, comprising a socket, a movable plug selectively engaged in the socket, a protective case that is fixed in relation to the socket and of which a front face is equipped with a mobile flap, and locking members, the socket being housed in the case, the case being designed to adopt selectively an open configuration and a closed configuration wherein respectively the flap authorizes and prohibits the access of the plug to the socket, and the locking members being designed to authorize or to prohibit selectively the open and closed configurations of the case, this device adopting selectively a state of use wherein the case is in open configuration and wherein the plug is engaged in the socket.

A device of this type is known to those skilled in the art by patent FR 2 526 234.

Although such a device does make it possible to effectively prohibit the access of a plug to a free socket, it is however improper in preventing the accidental or malicious operation which consists in removing a plug engaged in the socket in order to be able to introduce another therein.

The invention, which lies within this context, has for purpose to offer a device designed to meet this additional need.

SUMMARY

For this purpose, the device of the invention, moreover in accordance with the generic definition that the preamble hereinabove provides, is substantially characterized in that the locking members include a mobile latch, a runner, and a key, in that the key is designed to be selectively linked to the latch in translation and to imprint to this latch a sliding, prohibited by default, in the runner between a locked position and an unlocked position, in that the flap and the plug comprise respective retaining reliefs, and in that, in its locked position, the latch retains the retaining relief of the flap in the closed configuration of the case, and retains the retaining relief of the plug in the state of use of the device.

More preferably, the key is trapped by the runner in the unlocked position of the latch and is freely extractible from the runner in the locked position of the latch.

In an embodiment of the invention, it is possible to provide that the latch have a cross-through hole shaped in order to be penetrated by a key-bit of the key and arranged, in the locked position of the latch, across from an opening made in the front face of the case, that the runner have, across from the hole of the latch in the locked position of this latch, at least one catch elastically recalled to a rest position wherein it retains this latch in its locked position, that the opening of the front face of the case be extended by a slot made in this face parallel to the runner, that the key-bit of the key be shaped in order to displace, once inserted into the hole of the latch, each catch from its rest position, and that the presence of the key-bit in the hole of the latch link the key and the latch in translation, which results in that a sliding of the key in the slot provokes a sliding of the latch in the runner.

The slot advantageously has a width less than that of the key-bit, of which the dimensions are themselves less than those of the opening of the front face of the case, in such a way that the key-bit, once inserted into the hole of the latch, can be extracted from it only through the opening of the front face of the case.

The flap is for example slidably mounted in the front face of the case and returned to a closed position by a return spring.

In order to better fulfill its function, the runner can include at least two catches.

The latch has for example a collar and a bolt attached to the collar, the hole being made in the collar, and the bolt retaining selectively the flap or the plug.

In a possible embodiment, the socket is snapped onto the case.

The retaining relief of the plug comprises for example an elastic tab used to maintain this plug in the socket.

In the privileged application of the device for connecting of the invention, the socket is a multi-conducting socket, adapted for the parallel transfer of data.

BRIEF DESCRIPTION OF THE DRAWINGS

Other characteristics and advantages and of the invention shall result from the description of it which is provided hereinafter, for the purposes of information and in no way exhaustive, in reference to the annexed drawings, wherein.

DETAILED DESCRIPTION

As announced hereinabove, the invention relates to a device for connecting with secure access, comprising a socket 1, a movable plug 2, a protective case 3, and locking members for which details will be provided later and on which are substantially concentrated the advantages of the invention.

Figure 7:
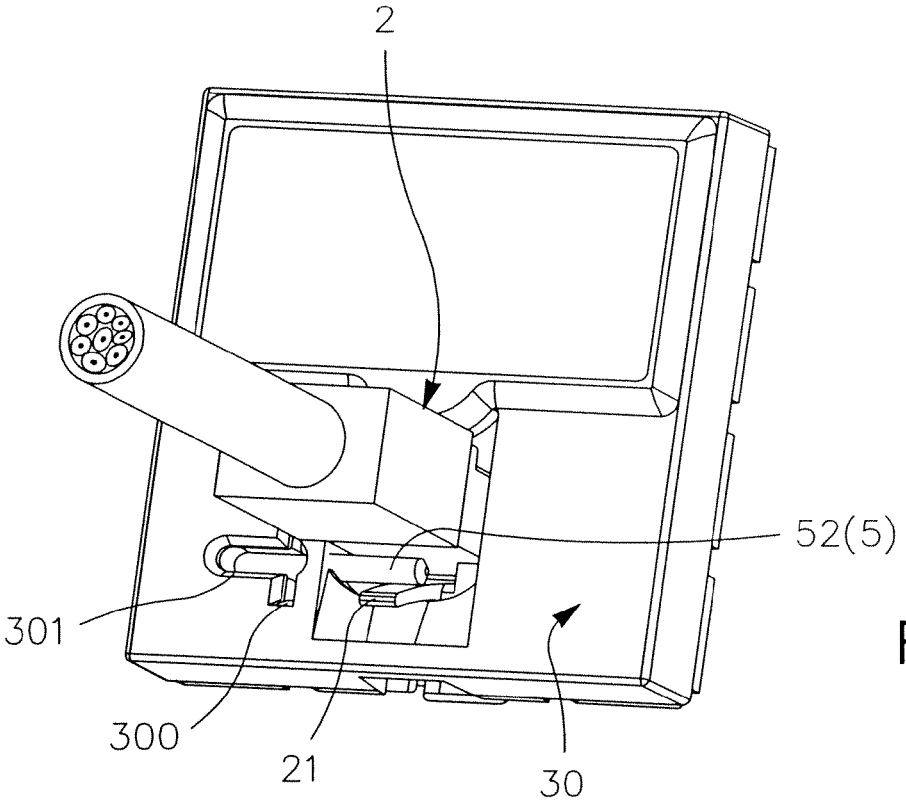
FIG. 7 is a perspective view of the device shown in the preceding figures, observed from the front and in its state of use.

The movable plug 2, which is visible in FIG. 7, is designed to be able to be engaged into the socket 1, itself for example constituted by a multi-conducting socket, adapted to the parallel transfer of data.

The socket 1 is housed in a fixed manner in the case 3, for example via mutual snapping of this socket and of this case.

Figure 2:
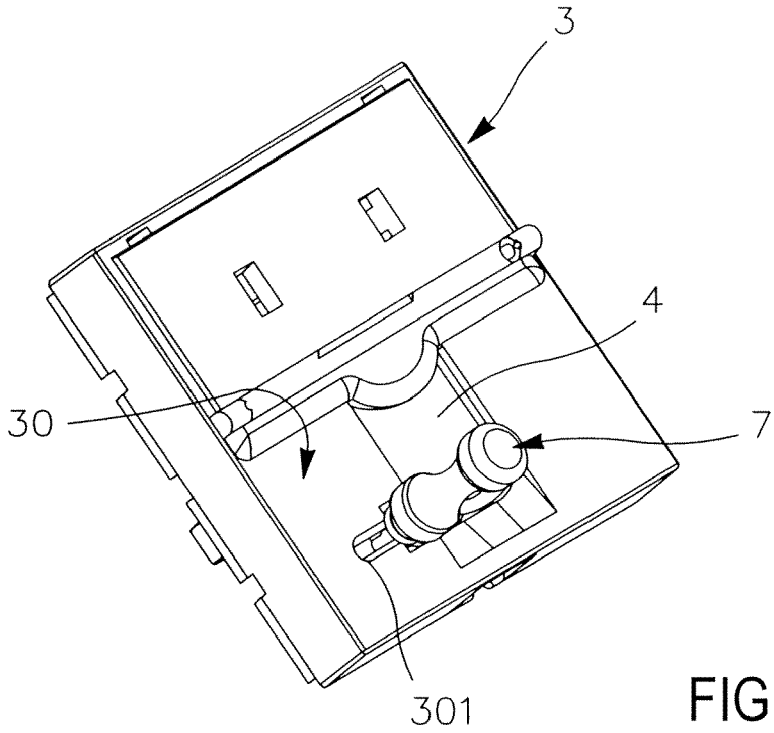
FIG. 2 is a perspective view of the device shown in FIG. 1, observed from the front.
Figure 3:
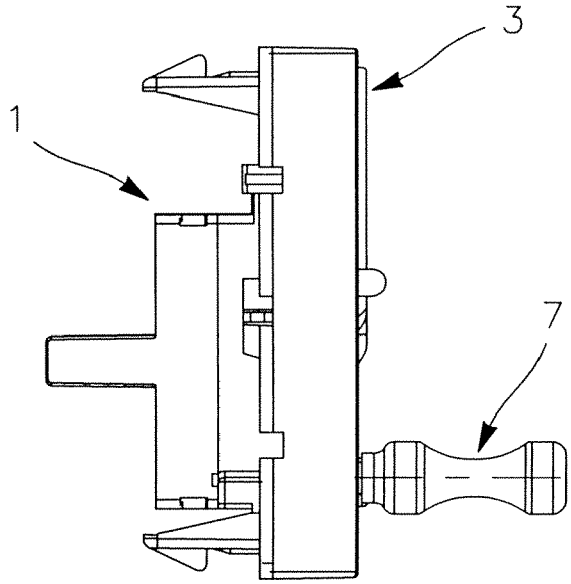
FIG. 3 is a side view of the device shown in FIGS. 1 and 2.
Figure 4:
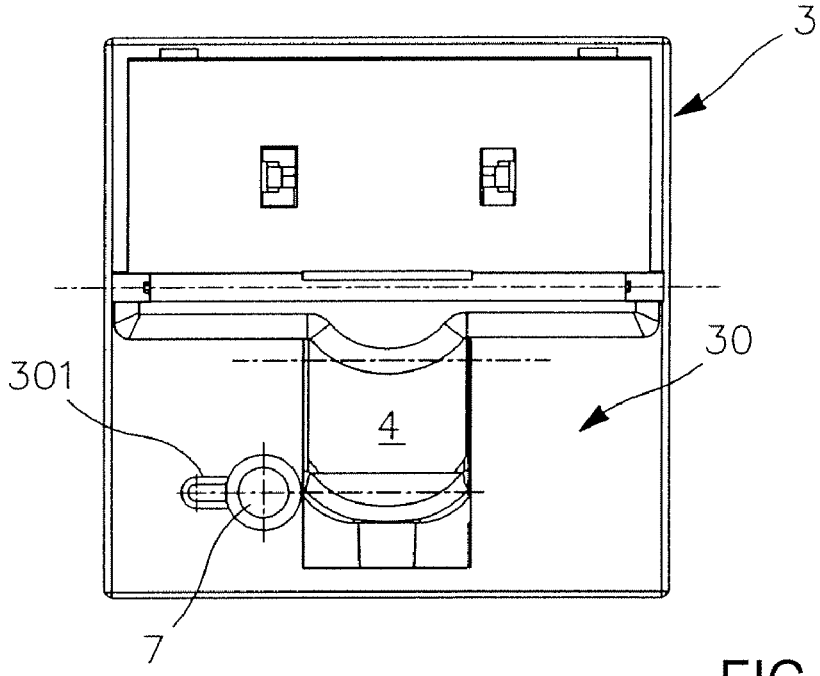
FIG. 4 is an elevational view of the device shown in the preceding figures, observed from the front and in the closed configuration of the case.

The case 3, which has a front face 30 equipped with a mobile flap 4, can as such adopt as desired an open configuration, wherein the flap 4 is in open position (FIGS. 6 and 7) and authorizes the access of the plug 2 to the socket 1, and a closed configuration, wherein the flap 4 is a closed position (FIGS. 2, 4, and 5) and prohibits the access of the plug 2 to the socket 1.

The locking members have precisely for function to authorize or to prohibit the open and closed configurations of the case 3.

FIG. 7 shows the device of the invention in its state of use, defined by the fact that the case 3 is in an open configuration and that the plug 2 is engaged in the socket 1.

According to the invention, the locking members include substantially a mobile latch 5, a runner 6, and a key 7.

The latch 5 has for example a collar 51 and a bolt 52 that is attached to this collar 51.

The key 7 has for function to all for a sliding of the latch 5 in the runner 6 between a locked position (which is visible in FIGS. 4, 5, and 7) and an unlocked position (which is visible in FIG. 6), this sliding being prohibited by default.

When the case is in its closed configuration and the latch 5 in its locked position, the bolt 52 of this latch is engaged in a retaining relief 41 of the flap 4 (FIG. 5), and maintains therefore this flap 4 in its closed position.

When the case is in its open configuration, the latch 5 in its locked position, and the device in its state of use, the bolt 52 of the latch 5 is engaged in a retaining relief 21 of the plug 2 (FIG. 7), for example constituted by the elastic tab which is used to maintain this plug 2 in the socket 1.

In these conditions, the bolt 52 of the latch 5 maintains as such the plug 2 in its position of insertion in the socket 1, thus prohibiting the extraction of this plug outside of the socket.

For this, the collar 51 of the latch 5 has for example a cross-through hole 510, which is shaped in order to be penetrated by a key-bit 70 of the key 7.

Figure 1:
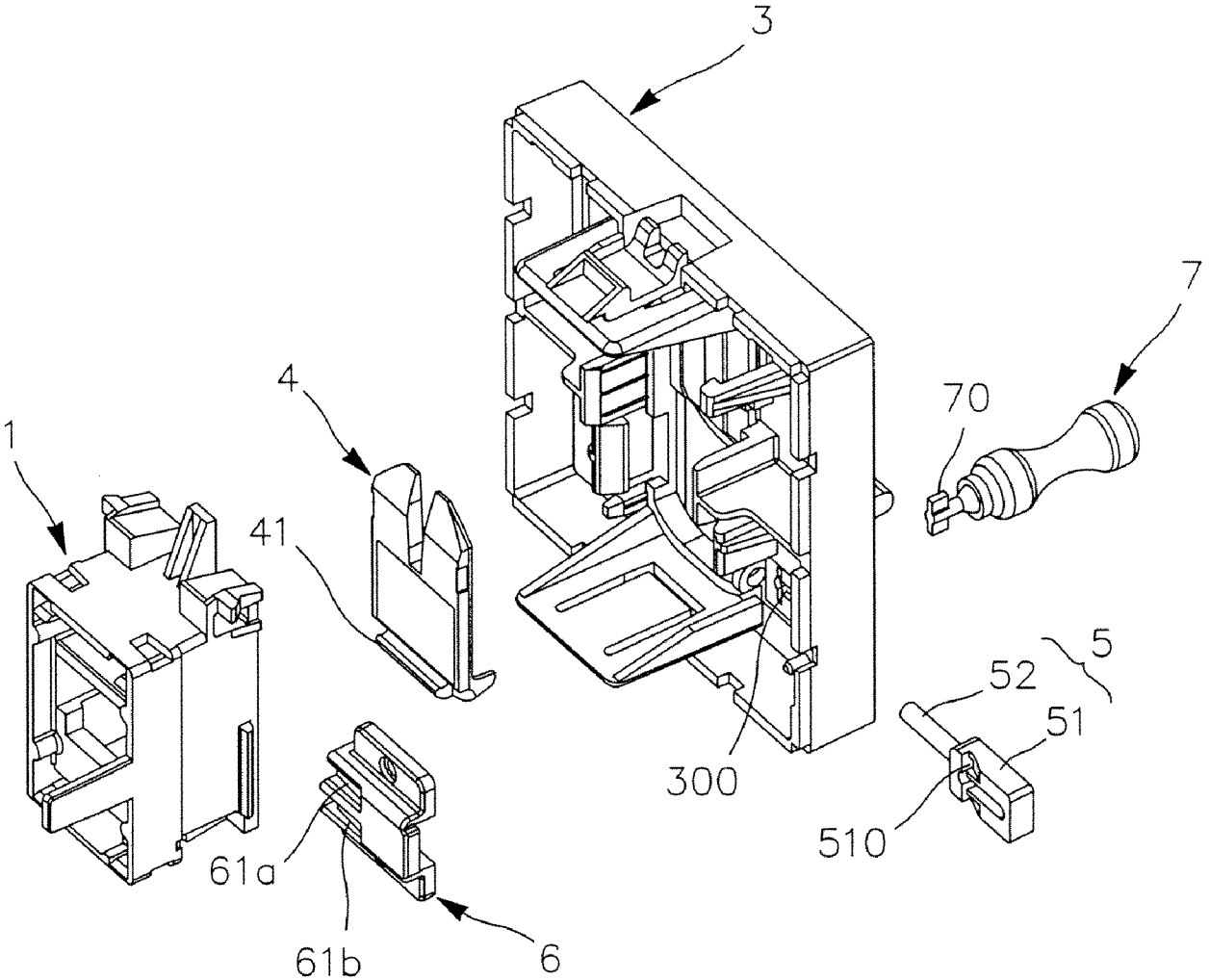
FIG. 1 is a general exploded view and in perspective of a device in accordance with the invention.

In the locked position of the latch 5, this hole 510 is arranged across from an opening 300 made in the front face 30 of the case 3 (see FIG. 1).

Figure 5:
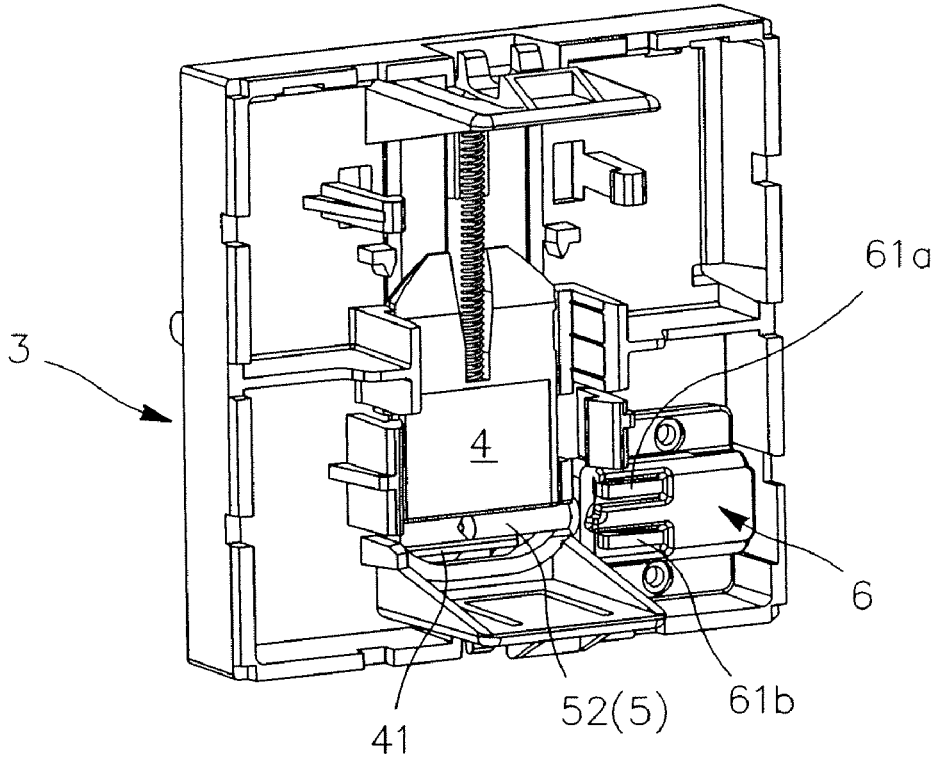
FIG. 5 is a perspective view of the device shown in the preceding figures, observed from the rear and in the closed configuration of the case.

As is shown in FIGS. 1 and 5, the runner 6 has two catches 61*a* and 61*b*, of which each is elastically recalled to a rest position wherein it retains the latch 5 in its=locked position.

Each of these catches 61*a* and 61*b* is arranged across from the opening 300 of the front face 30 of the case 3, i.e. again across from the hole 510 of the latch 5, in the position that this hole adopts for the locked position of this latch.

The key-bit 70 of the key 7 is shaped in order to be able to displace the catches 61*a* and 61*b* from their rest position when it is inserted into the opening 300 and pushed into the hole 510 of the latch 5.

This opening 300 is moreover extended by a slot 301, which is made in the front face 30 of the case 3, parallel to the runner 6.

As the insertion of the key-bit 70 into the hole 510 of the latch 5 links the key 7 and the latch 5 in translation, the sliding of the key 7 in the slot 301 thus makes it possible to slide the latch 5 in the runner 6 to its unlocked position, once the catches 61*a* and 61*b* displaced from their rest position by the key-bit 70.

This arrangement can be perfected by providing that the key 7 be trapped by the runner 6 in the unlocked position of the latch 5, and that it be freely extractible from this runner 6 in the locked position of the latch 5.

For this, it is sufficient to provide the slot 301 with a dimension, or width, that is less than that of the key-bit 70 according to the direction transversal to the sliding of the latch 5, the key-bit having itself of course dimensions that are less than those of the opening 300 of the front face 30 of the case 3 in order to be introduced therein.

As such, once inserted into the hole 510 of the latch 5, the key-bit 70 can be extracted from it only through the opening 300 of the front face 30 of the case 3.

Finally, as is shown in FIG. 5, the flap 4 is for example slidably mounted in the front face 30 of the case 3 and recalled to its closing position by a return spring 42.

The instructions for the device of the invention are as follows.

When the socket 1 is not used, the device is in the state shown in FIG. 5, the case being in closed configuration, and the person specifically authorized to use this socket having the key 7 exclusively.

In this configuration, the bolt 52 of the latch 5 retains the flap 4 in its closed position.

Figure 6:
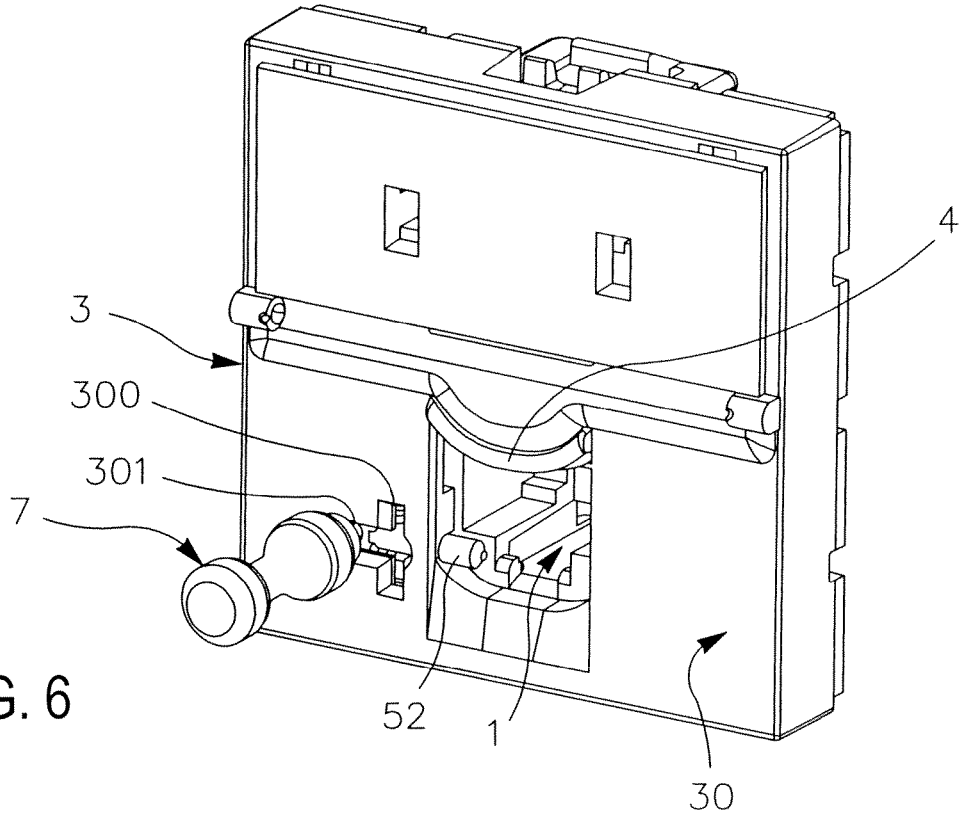
FIG. 6 is a perspective view of the device shown in the preceding figures, observed from the front and in the open configuration of the case.

When the authorized user of the socket 1 desires to engage therein the plug 2, he introduces the key-bit 70 of the key 7 into the opening 300 of the case 3, pushes this key-bit into the rear of the hole 510 of the latch 5, displaces as such the catches 61*a* and 61*b* from their rest position, then displaces the key 7 in the slot 301, thus bringing the latch to its unlocked position shown in FIG. 6.

The authorized user of the socket 1 can then engage the plug 2 into the socket 1, the key 7 being still trapped in the slot 301.

Then, this user replaces the latch 5 in its locked position be displacing the key 7 in this slot 301 until it is across from the opening 300.

The user can then remove his key 7, leaving the device in its configuration of use such as is shown in FIG. 7, and wherein the bolt 52 of the latch 5 prohibits the extraction of the plug 2 outside of the socket 1.

The invention claimed is:

1. Device for connecting with secure access, comprising a socket (1), a movable plug (2) selectively engaged in the socket, a protective case (3) that is fixed in relation to the socket (1) and of which a front face (30) is equipped with a mobile flap (4), and locking members (5-7), the socket (1) being housed in the case (3), the case (3) being designed in order to adopt selectively an open configuration and a closed configuration wherein respectively the flap (4) authorizes and prohibits the access of the plug (2) to the socket (1), and the locking members (5-7) being designed to authorize or prohibit selectively the open and closed configurations of the case (3), this device adopting selectively a state of use wherein the case (3) is in open configuration and wherein the plug (2) is engaged in the socket (1), characterized in that the locking members (5-7) include a mobile latch (5), a runner (6), and a key (7), in that the key (7) is designed to be selectively linked to the latch (5) in translation and in order to imprint to this latch (5) a sliding, prohibited by default, in the runner (6) between a locked position and an unlocked position, in that the flap (4) and the plug (2) comprise respective retaining reliefs (41, 21), and in that, in its locked position, the latch (5) retains the retaining relief (41) of the flap (4) in the closed configuration of the case (3), and retains the retaining relief (21) of the plug (2) in the state of use of the device.

2. Device for connecting according to claim 1, characterized in that the flap (4) is slidably mounted in the front face (30) of the case (3) and recalled to a closed position by a return spring (42).

3. Device for connecting according to claim 1, characterized in that the latch (5) has a collar (51) and a bolt (52) attached to the collar (51), in that the hole (510) is made in the collar (51), and in that the bolt (52) retains selectively the flap (4) or the plug (2).

4. Device for connecting according to claim 1, characterized in that the socket (1) is snapped onto the case (3).

5. Device for connecting according to claim 1, characterized in that the retaining relief (21) of the plug (2) comprises an elastic tab (21) used to maintain this plug (2) in the socket (1).

6. Device for connecting according to claim 1, characterized in that the socket (1) is a multi-conducting socket, adapted to the parallel transfer of data.

7. Device according to claim 1, characterized in that the latch (5) has a cross-through hole (510) shaped in order to be penetrated by a key-bit (70) of the key (7) and arranged, in the locked position of the latch (5), across from an opening (300) made in the front face (30) of the case (3), in that the runner (6) has, across from the hole (510) of the latch (5) in the locked position of this latch, at least one catch (61*a*, 61*b*) elastically recalled to a rest position wherein it retains this latch (5) in its locked position, in that the opening (300) of the front face (30) of the case (3) is extended by a slot (301) made in this face (30) parallel to the runner (6), in that the key-bit (70) of the key (7) is shaped in order to displace, once inserted into the hole (510) of the latch (5), each catch (61*a*, 61*b*) from its rest position, and in that presence of the key-bit (70) in the hole (510) of the latch (5) links the key (7) and the latch (5) in translation, which results in that a sliding of the key (7) in the slot (301) provokes a sliding of the latch (5) in the runner (6).

8. Device for connecting according to claim 7, characterized in that the slot (301) has a width less than that of the key-bit (70), of which the dimensions are themselves less than those of the opening (300) of the front face (30) of the case (3), which results in that the key-bit (70), once inserted in the hole (510) of the latch (5), can be extracted from it only through the opening (300) of the front face (30) of the case (3).

9. Device for connecting according to claim 8, characterized in that the runner (6) comprises at least two catches (61*a*, 61*b*).

10. Device for connecting according to claim 1, characterized in that the key (7) is trapped by the runner (6) in the unlocked position of the latch (5) and is freely extractible from the runner (6) in the locked position of the latch (5).

11. Device according to claim 10, characterized in that the latch (5) has a cross-through hole (510) shaped in order to be penetrated by a key-bit (70) of the key (7) and arranged, in the locked position of the latch (5), across from an opening (300) made in the front face (30) of the case (3), in that the runner (6) has, across from the hole (510) of the latch (5) in the locked position of this latch, at least one catch (61*a*, 61*b*) elastically recalled to a rest position wherein it retains this latch (5) in its locked position, in that the opening (300) of the front face (30) of the case (3) is extended by a slot (301) made in this face (30) parallel to the runner (6), in that the key-bit (70) of the key (7) is shaped in order to displace, once inserted into the hole (510) of the latch (5), each catch (61*a*, 61*b*) from its rest position, and in that presence of the key-bit (70) in the hole (510) of the latch (5) links the key (7) and the latch (5) in translation, which results in that a sliding of the key (7) in the slot (301) provokes a sliding of the latch (5) in the runner (6).

12. Device for connecting according to claim 10, characterized in that the slot (301) has a width less than that of the key-bit (70), of which the dimensions are themselves less than those of the opening (300) of the front face (30) of the case (3), which results in that the key-bit (70), once inserted in the hole (510) of the latch (5), can be extracted from it only through the opening (300) of the front face (30) of the case (3).

* * * * *